US007204181B2

(12) United States Patent
Goedeking

(10) Patent No.: US 7,204,181 B2
(45) Date of Patent: Apr. 17, 2007

(54) REVERSIBLE FLOATING PUNCH RETAINER FOR PUNCH CHANGE RETAINER TOOL

(75) Inventor: Van Lynn Goedeking, Miamisburg, OH (US)

(73) Assignee: Dayton Progress Corporation, Dayton, OH (US)

( * ) Notice: Subject to any disclaimer, the term of this patent is extended or adjusted under 35 U.S.C. 154(b) by 404 days.

(21) Appl. No.: 10/884,598

(22) Filed: Jul. 2, 2004

(65) Prior Publication Data

US 2006/0000336 A1 Jan. 5, 2006

(51) Int. Cl.
*B21D 28/24* (2006.01)
*B26F 1/14* (2006.01)

(52) U.S. Cl. ..... 83/698.91; 83/563; 83/684; 83/698.31; 83/698.61; 234/114; 234/116

(58) Field of Classification Search ..... 83/698.91, 83/698.61, 698.51, 698.31, 684, 691, 954, 83/685, 698.11, 671, 687, 698.41, 686, 549, 83/698.71, 618, 563; 234/111, 114, 116
See application file for complete search history.

(56) References Cited

U.S. PATENT DOCUMENTS

| | | | | |
|---|---|---|---|---|
| 1,979,059 | A | 10/1934 | Wallman | |
| 2,137,557 | A | 11/1938 | Ziganek | |
| 2,500,420 | A | 3/1950 | Koning | |
| 2,574,910 | A | 11/1951 | Chaney | |
| 2,590,548 | A | 3/1952 | Kopczynski | |
| 2,920,913 | A * | 1/1960 | Antila | 83/698.91 |
| 3,245,694 | A | 4/1966 | Parker | |
| 3,429,212 | A | 2/1969 | Wiesbeck | |
| 3,563,124 | A | 2/1971 | Gargrave | |
| 3,589,226 | A | 6/1971 | Shadowens, Jr. | |
| 4,339,976 | A * | 7/1982 | Wallis | 83/684 |
| 4,377,100 | A | 3/1983 | Wallis | |
| 4,558,620 | A * | 12/1985 | Wallis | 83/699.31 |
| 4,726,270 | A | 2/1988 | Lucas | |
| 5,144,872 | A * | 9/1992 | Kakimoto | 83/13 |
| 5,284,069 | A | 2/1994 | Wellman | |
| 5,359,914 | A | 11/1994 | Brown | |
| 5,410,932 | A | 5/1995 | Moellering | |
| 5,678,468 | A * | 10/1997 | Lozano Bonet et al. | 83/588 |
| 5,839,183 | A | 11/1998 | Powlett | |
| 5,881,625 | A * | 3/1999 | Wellman | 83/563 |
| 6,182,545 | B1 * | 2/2001 | Janek, Jr. | 83/13 |

(Continued)

*Primary Examiner*—Boyer D. Ashley
*Assistant Examiner*—Ghassem Alie
(74) *Attorney, Agent, or Firm*—Stevens & Showalter LLP

(57) ABSTRACT

A punch change retainer for positioning a floating punch in a retracted, disengage position and an extended, engage position. The change retainer includes a change retainer body and a punch retainer receiving aperture extending upwardly through the change retainer body from a bottom surface thereof. A gagging member is located in the change retainer body and is actuable by an actuator between a retracted position distal from a nose portion of the change retainer body and an extended position adjacent the nose portion of the change retainer body. A floating punch retainer is receivable within the punch retainer receiving aperture, and includes an upper end positioned for engagement with the gagging member. A punch receiving hole is defined in the floating punch retainer; where the punch receiving hole is adapted to be rotatably positioned about a longitudinal center line of the floating punch retainer within the punch retainer receiving aperture.

10 Claims, 4 Drawing Sheets

U.S. PATENT DOCUMENTS 6,324,768 B1 12/2001 Wellman
6,463,839 B2 * 10/2002 Ohtsuka et al. ..... 83/698.91
6,669,399 B2 12/2003 Janek, Jr.
6,679,147 B1 1/2004 Chaulklin
6,739,244 B1 * 5/2004 Carbaugh ..... 101/3.1
6,918,333 B2 * 7/2005 Oshita ..... 83/698.61
2004/0144230 A1 * 7/2004 Oshita ..... 83/684

* cited by examiner

REVERSIBLE FLOATING PUNCH RETAINER FOR PUNCH CHANGE RETAINER TOOL

BACKGROUND OF THE INVENTION

1. Field of the Invention

The present invention relates generally to a punch change retainer for use in a punch and die assembly, and more particularly, to punch change retainer including a floating punch retainer which is adapted to reversibly provide different punch retaining locations about a longitudinal center line of the floating punch retainer.

2. Description of Related Art

During manufacture of sheet metal or similar products, it is often necessary to form one or more holes in the workpiece material forming the product. Typically, a punch and die assembly is used to form the holes in such applications, particularly where large production volumes of the products are required. A production punch and die assembly generally includes an upper die shoe supported for movement toward a lower die shoe. A punch retainer is typically mounted to the upper die shoe and secures a punch to the die shoe. The punch is movable towards a die bushing secured to the opposing die by means of a die bushing retainer. Typically, the retainers are removably secured, e.g., through cap screws, to their respective die shoes, and the punch bushing and die bushing are also removably secured in their respective retainers. The retainers are positioned on the respective die shoes to locate the punches and corresponding die bushings such that holes are provided at predetermined precise locations on the workpiece.

In order to maximize the use of the punch and die assembly, the punch and die assembly may be reconfigured in order to perform different production runs. Such reconfiguration may be accomplished by attaching the punch and die bushing retainers to the die shoes at particular locations associated with the product to be produced. Alternatively, some constructions of punch and die assemblies incorporate change retainer tooling in which a movable punch retainer body supports a punch and is located in a change retainer housing. The change retainer housing is typically formed as an elongated member having the movable punch retainer located at a nose end of the change retainer housing and an actuator located toward the other end of the change retainer housing. The actuator actuates a gagging member to move the movable punch retainer between an actuated position where the punch is extended to operate on a workpiece, and a retracted position in which the punch is moved in toward the die shoe to a position where it will not engage the workpiece during movement of the die shoe. By providing a plurality of punch change retainer tools on a die shoe and programming the associated actuators to activate the punches for predetermined hole stamping patterns on the workpiece located in the assembly, the punch and die assembly may be readily reconfigured to provide different stamping patterns through activation and de-activation of the select ones of the punches. Such change retainers improve the efficiency of setting up the tooling for a hole stamping operation by avoiding the necessity of removing punches which are not required for a particular operation, while enabling activation of punches to an engagement position without requiring manual installation of punches.

In order to ensure standardization of tooling associated with change retainers incorporating ball lock punch retainers, change retainer structures have generally been constructed in accordance with the North American Automotive Metric Standard (NAAMS) which positions the center of the punch tool a predetermined distance from a reference dowel positioned in a surface of the change retainer body that is in cooperating engagement with a surface of the die shoe. The dimensions specified by NAAMS provide a point of reference for designing tooling for punch and die assemblies incorporating change retainers.

Applications incorporating change retainers frequently position plural change retainers in nose-to-nose relation with each other in order to closely position the holes formed by the punches of the adjacent retainers. Generally, the spacing between punches located in adjacent change retainers has been controlled by the thickness of the material required at the nose portion of the retainer, as well as by dimensional constraints imposed by the NAAMS. Further, the cost of change retainers is relatively high compared to conventional stationary punch retainers such that variations in design from the standardized dimensional criteria for change retainers have generally not been economical.

There is a need for a change retainer capable of conforming to industry standards for locating the punch tooling while also readily providing for positioning of punch tooling in alternative positions, such as providing alternative spacing of adjacent tooling relative to each other, to meet a wider variety of job requirements in a punch and die assembly.

SUMMARY OF THE INVENTION

The present invention provides for variations in positioning of punch tooling without substantially altering the components comprising the tooling. In particular, alternative positioning of tooling held by a change retainer is provided in a direction perpendicular to the direction of reciprocating movement of the tooling, facilitating alternative positioning of plural punch tools relative to each other.

In accordance with one aspect of the invention, a punch change retainer is provided positioning a floating punch in a retracted, disengage position and an extended, engage position. The change retainer comprises a change retainer body including a nose portion at a front end of the change retainer body and an actuator at a rear end of the change retainer body; a punch retainer receiving aperture extending upwardly through the change retainer body from a bottom surface thereof; a gagging member actuable by the actuator between a retracted position distal from the nose portion of the change retainer body and an extended position adjacent the nose portion of the change retainer body; a floating punch retainer receivable within the punch retainer receiving aperture, an upper end of the floating punch retainer positioned for engagement with the gagging member, the floating punch retainer defining a longitudinal center line located in a front to rear direction; a punch receiving hole defined in the floating punch retainer; and the floating punch retainer being rotatably positioned about the longitudinal center line within the punch retainer receiving aperture.

In another aspect of the invention, a punch change retainer is provided positioning a floating punch in a retracted, disengage position and an extended, engage position. The change retainer comprises a change retainer body including a nose portion at a front end of the change retainer body and an actuator at a rear end of the change retainer body; a punch retainer receiving aperture extending upwardly through the change retainer body from a bottom surface thereof; a gagging member actuable by the actuator between a retracted position distal from the nose portion of the change retainer body and an extended position adjacent the nose portion of the change retainer body; a floating punch retainer receivable within the punch retainer receiving aperture, an upper end of the floating punch retainer positioned for engagement with the gagging member, the floating punch retainer defining a longitudinal center line; a punch receiving hole defined in the floating punch retainer and offset from the longitudinal center line and located between the longitudinal center line and the nose portion of the change retainer body; and wherein the gagging member includes a lower surface engaging an upper surface of the floating punch retainer, the lower surface of the gagging member extendable to a location substantially over the punch receiving hole.

In a further aspect of the invention, a punch change retainer is provided positioning a floating punch in a retracted, disengage position and an extended, engage position. The change retainer comprising: a change retainer body including a nose portion at a front end of the change retainer body and an actuator at a rear end of the change retainer body; a punch retainer receiving aperture extending upwardly through the change retainer body from a bottom surface thereof; a gagging member actuable by the actuator between a retracted position distal from the nose portion of the change retainer body and an extended position adjacent the nose portion of the change retainer body; a floating punch retainer receivable within the punch retainer receiving aperture, an upper end of the floating punch retainer positioned for engagement with the gagging member, the floating punch retainer defining a longitudinal center line located in a front to rear direction; a punch receiving hole defined in the floating punch retainer and offset from the longitudinal center line; and wherein the punch receiving hole is reversible within the punch retainer receiving aperture about the longitudinal center line to locate the punch receiving hole at two predetermined positions within the change retainer body.

BRIEF DESCRIPTION OF THE DRAWINGS

The following detailed description of the preferred embodiments of the present invention can be best understood when read in conjunction with the following drawings, where like structure is indicated with like reference numerals, and in which.

DETAILED DESCRIPTION OF THE PREFERRED EMBODIMENT

Figure 1:
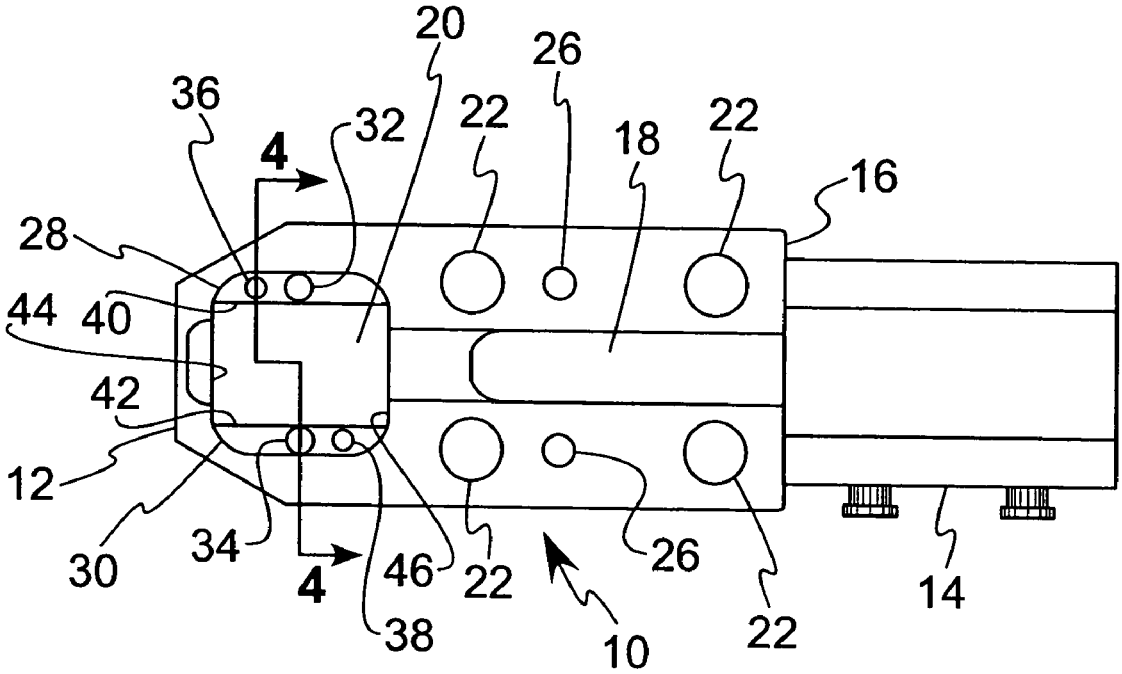
FIG. 1 is a top plan view of a change retainer body of the present invention with the backing plate of the change retainer body removed.

Referring to FIG. 1 the change retainer of the present invention includes a change retainer body 10 including a nose portion 12 and an actuator 14 at a rear end 16 of the change retainer body 10. The change retainer body 10 includes a gagging member slot 18 located adjacent the actuator 14, and a punch retainer receiving aperture 20 adjacent the nose portion 12 of the change retainer body 10. The change retainer body 10 further includes mounting apertures 22 for receiving fasteners for attaching the change retainer body 10 to the lower surface of a die shoe 24 of a punch press (see FIG. 8). In addition, alignment holes 26 are provided for receiving alignment members, such as dowels, which engage within corresponding holes in the die shoe 24 to precisely position the change retainer body on the die shoe 24.

The retainer receiving aperture 20 includes opposing ledge areas 28, 30 located on either lateral side of the retainer receiving aperture 20. Each of the ledge areas 28, 30 include a respective spring seat 32, 34 and an alignment pawl aperture 36, 38. The aperture 20 is formed with a symmetrical shape in the preferred embodiment where lateral sides 40, 42 are formed parallel to each other, and front and rear sides 44, 46 are formed parallel to each other. The sides 40, 42 and 44, 46 operate to guide a floating punch retainer 64 (FIG. 2) during vertical reciprocating movement of the punch retainer 64.

Figure 2:
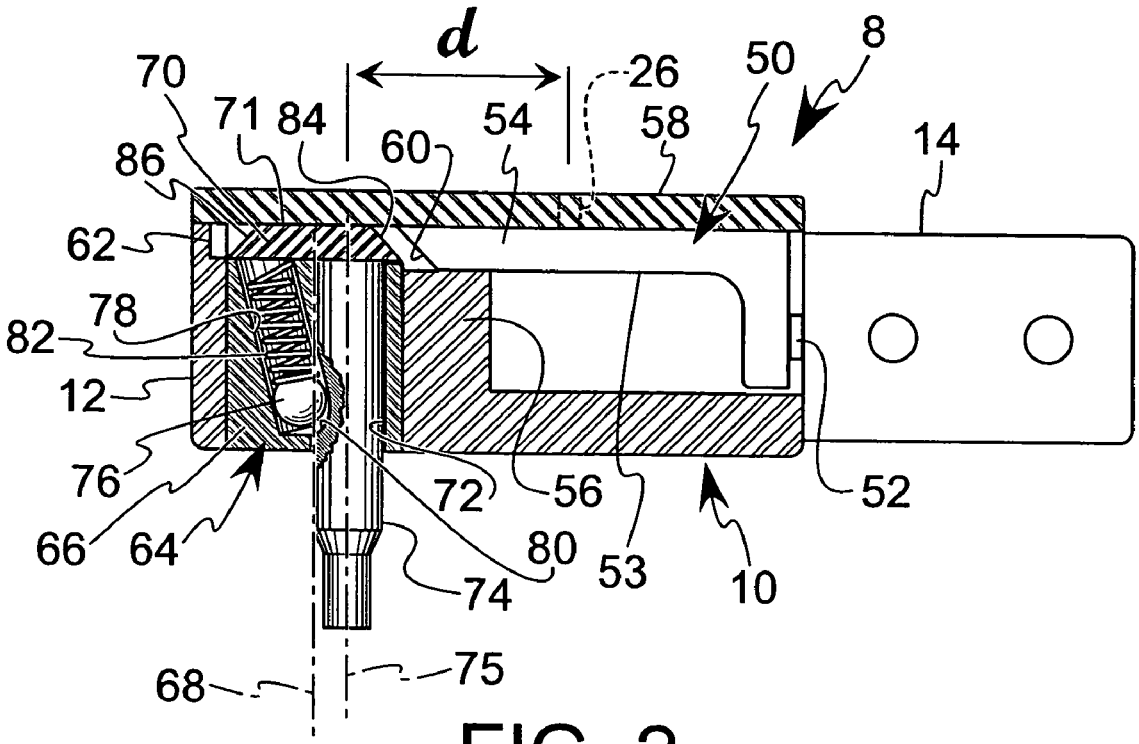
FIG. 2 is a partial cross-section side elevational view of the change retainer of the present invention with the floating punch retainer body shown in a first orientation, and located in a retracted position.
Figure 3:
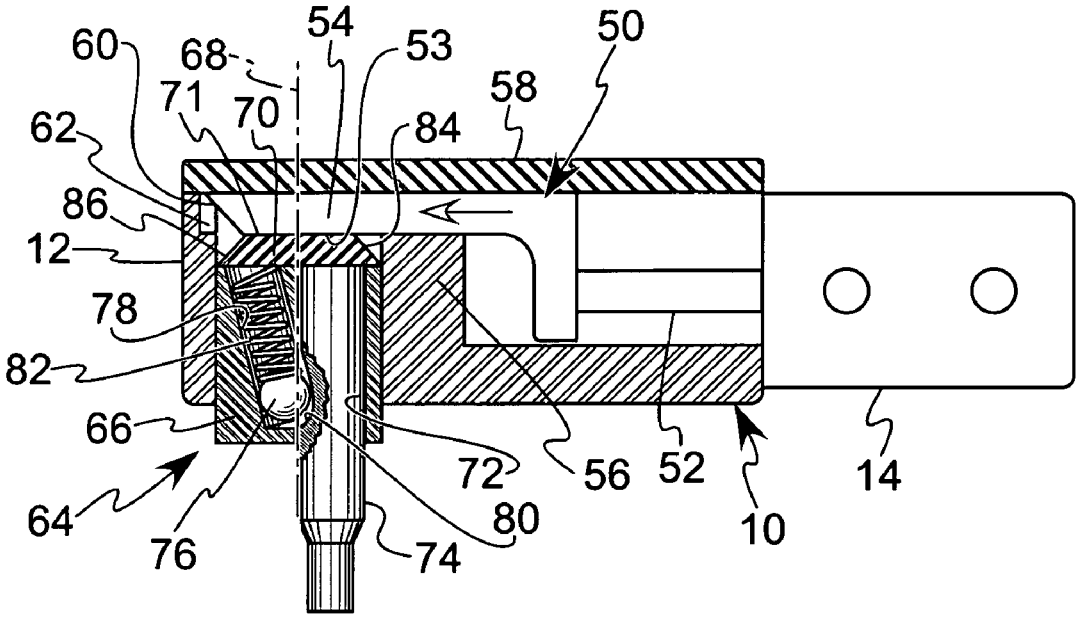
FIG. 3 is a partial cross-section side elevational view showing the floating punch retainer body in the orientation of FIG. 2, and located in an extended position.

Referring to FIGS. 2 and 3, the assembled change retainer 8 is illustrated and includes a gagging member 50 connecting to a reciprocating actuated rod 52 of the actuator 14. The gagging member 50 includes a forward extension 54 passing over a ledge portion 56 of the change retainer body 10, where the extension 54 passes between the ledge portion 56 and a backing plate 58 for the change retainer body 10. The extension 54 includes an angled ramp portion 60 at a forward end thereof which is movable between a retracted position (FIG. 2) with the ramp portion 60 located adjacent the rear side 46 of the aperture 20 and an extended position (FIG. 3) adjacent the front side 44 of the aperture 20 at the nose 12 of the change retainer body 10. The front side 44 of the aperture 20 is preferably formed with a clearance aperture or slot 62 to accommodate a long forward stroke of the gagging member extension 54. The actuator 14 for actuating movement of the gagging member 50 is preferably a pneumatic cylinder. However, other actuators such as hydraulic, electric or equivalent actuators may be utilized within the scope of this invention.

The floating punch retainer 64 is vertically movable in reciprocating movement between an upper or retracted, disengage position (FIG. 2) and a lower or extended, engage position (FIG. 3). The floating punch retainer 64 comprises a punch retainer body 66, and a backing plate 70 attached to the punch retainer body 66 at an upper end of the punch retainer 64. The punch retainer 64 defines a longitudinal center line 68 located substantially centrally in the aperture 20 between the lateral sides 40, 42 and the front and rear sides 44, 46, and the punch retainer 64 is generally symmetrical about the longitudinal center line 68. A punch receiving hole 72 is defined by a bore passing vertically through the punch retainer body 66 and is offset from the longitudinal center line 68 for receiving a punch 74. In the configuration illustrated in FIG. 2, the distance d, along the longitudinal center of the change retainer 8, from the center 75 of the punch receiving hole 72 to the location of the alignment holes 26 is set to correspond to the NAAMS dimension (see also FIG. 8). The punch 74 is held in position within the punch receiving hole 72 by a ball element 76 located within an angled bore 78 and biased into locking engagement with a recess 80 in a shank portion of the punch 74 by a coiled compression spring 82. It should be understood that the invention is not limited to the particular illustrated structure for retaining the punch 74, and that other punch structures could be incorporated in the present invention, including headed punch structures. Further, while the present change retainer 8, is designed to provide dimensions corresponding to the NAAMS dimension, the scope of the invention is not intended to be limited to these particular dimensions.

The backing plate 70 is formed with first and second ramp portions 84, 86 located at rear and front sides of the backing plate 70, respectively. As seen in FIGS. 2 and 3, the first ramp portion 84 is engaged by the ramp portion 60 of the gagging member 50 as the gagging member 50 moves forwardly from a distal position toward the nose portion 12 of the change retainer body 10, causing the floating punch retainer 64 to move to the extended position so as to position the end of the punch 74 to engage a workpiece located below the punch 74 during reciprocating movement of the die shoe 24. The floating punch retainer 64 will move downwardly a distance equal to the thickness of the gagging member extension 54. In this position, a lower surface 53 of the gagging member extension 54 engages an upper surface 71 of the backing plate 70 to provide a support element against the upper surface 71 of the backing plate 70. When the gagging member 50 moves rearwardly, the floating punch retainer 64 returns to the unactuated, retracted position so as to position the end of the punch 74 away from engagement with a workpiece during reciprocating movement of the die shoe 24.

Figure 4:
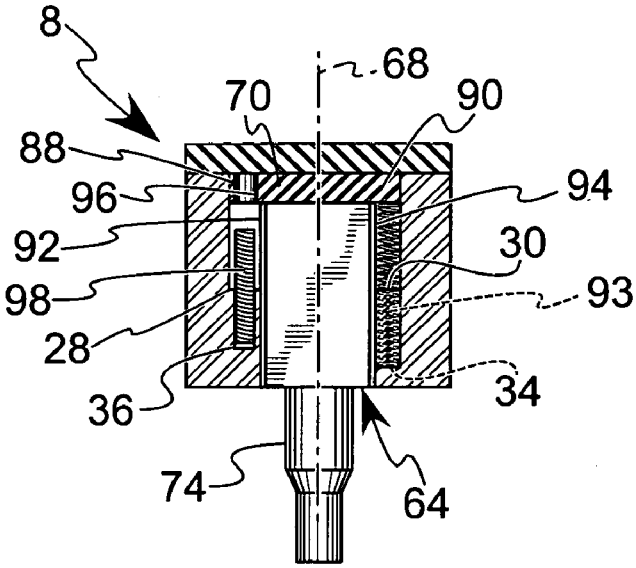
FIG. 4 is a partial cross-section end elevation view taken through the assembled change retainer along line 4—4 in FIG. 1, in which the punch retainer body is depicted in solid.
Figure 5:
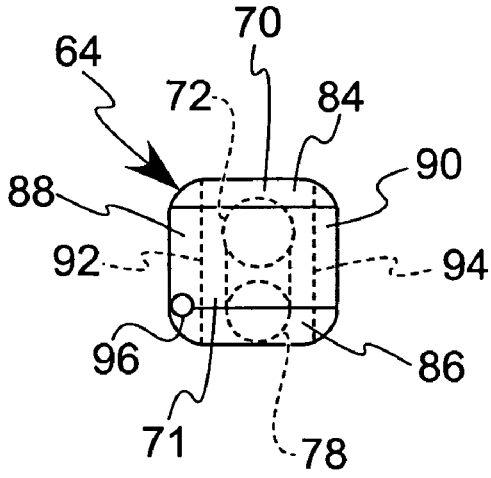
FIG. 5 is a top plan view of the floating punch retainer.

Referring to FIGS. 4 and 5, the backing plate 70 is formed with lateral extensions 88, 90 which extend laterally outwardly beyond respective sides 92, 94 of the punch retainer body 66, and which are located in facing relationship to the ledges 28, 30. Each lateral extension 88, 90 is engaged on a lower surface thereof by a spring 93 (only one shown) which rest in the spring seats 32, 34 to provide a biasing force for biasing the punch retainer 64 toward the retracted position. In addition, the lateral extension 88 is formed with a passage 96 for cooperating with a pawl element 98 located within the pawl aperture 36. The pawl element 98 may comprise a set screw, a dowel or an equivalent extension for engaging within the passage 96 in the backing plate, 70. The cooperation of the pawl element 98 with the passage 96 ensures that the floating punch retainer 64 is assembled into the change retainer body 10 in a specified orientation. If the punch retainer 64 is rotated from the specified orientation, the pawl element 98 will engage the backing plate 70, preventing actuation of the punch retainer 64 when the gagging member 50 is actuated. Thus, proper assembly or reassembly of the change retainer is assured in the event the floating punch retainer 64 is removed from the change retainer body 10. When the punch retainer 64 is properly assembled in the change retainer body 10, the punch retainer 64 may be actuated to move downwardly such that the lower surfaces of the lateral extensions 88, 90 move toward the respective ledges 28, 30, with the pawl element 98 passing through the passage 96 in vertical sliding engagement. It should be noted that although the passage 96 is illustrated as an aperture, the passage 96 may alternatively be provided as a notch in the side of the lateral extension 88 to provide clearance for the pawl element 98.

Figure 6:
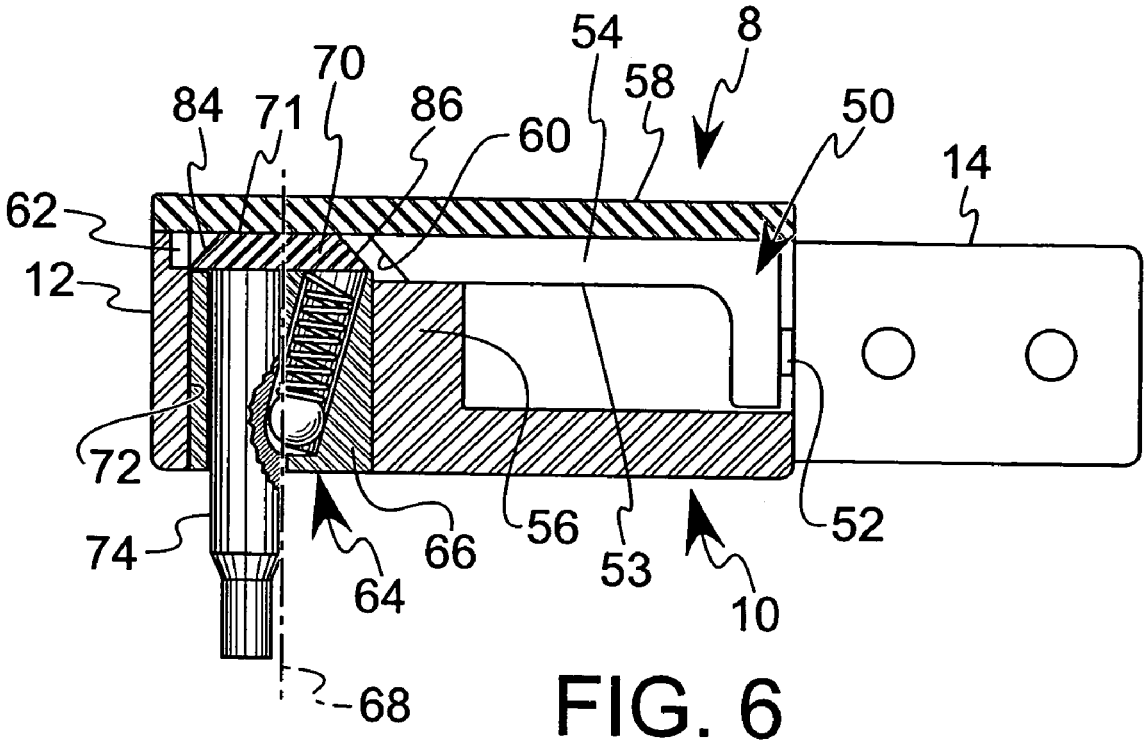
FIG. 6 is a partial cross-section side elevational view showing the floating punch retainer body in a second orientation, and located in a retracted position.
Figure 7:
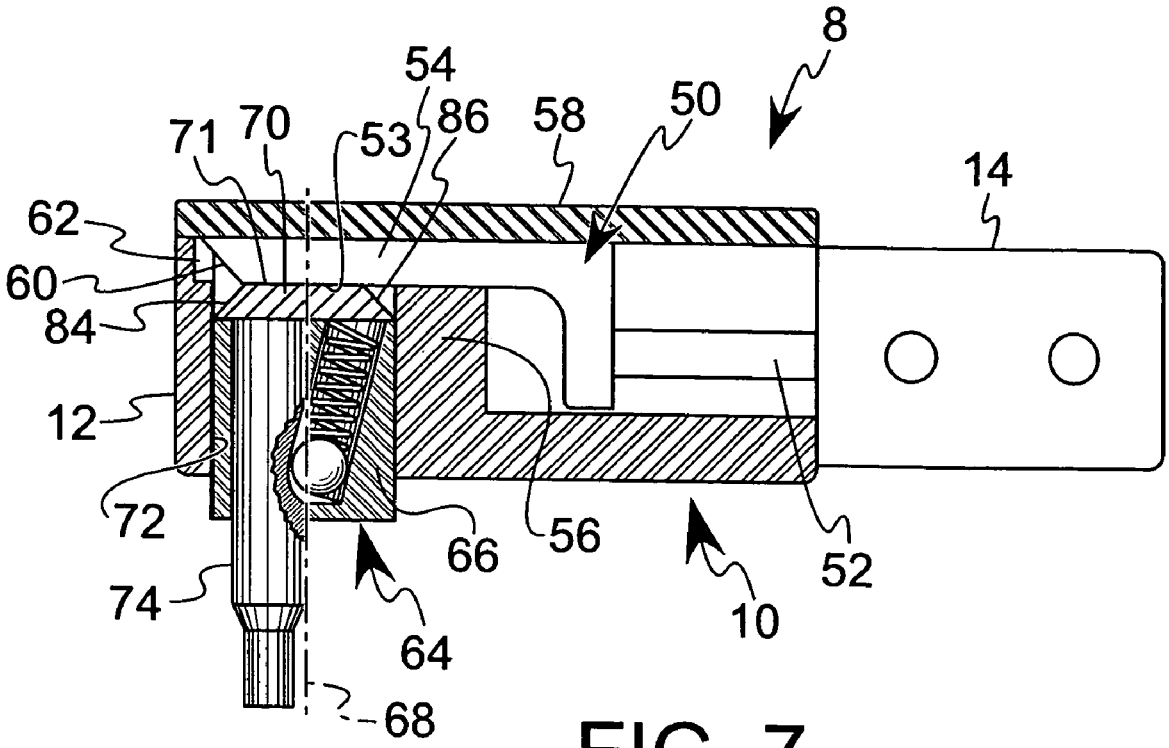
FIG. 7 is a partial cross-section side elevational view showing the floating punch retainer body in the orientation of FIG. 6, and located in an extended position.

Referring to FIGS. 6 and 7, an alternative position of the punch receiving hole 72 within the change retainer body 10 is illustrated where the location of the punch receiving hole 72 is closer to the nose 12 of the change retainer body 10 than that provided by the location illustrated in FIGS. 2 and 3. In accordance with the illustrated embodiment of the invention, the punch retainer 64 is rotatable about the longitudinal center line 68 to position the second ramp portion 86 of the backing plate 70 adjacent to the ramp portion 60 of the gagging member 50. In order to enable actuation of the punch 64 in the rotated orientation, the pawl member 98 must be moved from the pawl aperture 36 on the ledge 28 to the pawl aperture 38 on the opposite ledge 30. Thus, in the rotated orientation, the passage 96 in the lateral extension 88 will be located over the pawl element 98 on the ledge 30 to ensure proper assembly of the punch retainer 64 within the change retainer body 10.

FIG. 6 illustrates the punch retainer 64 in a retracted position with the backing plate ramp portion 86 located in position adjacent to the gagging member ramp portion 60. FIG. 7 illustrates the punch retainer 64 in an extended position for performing a punching operation on a workpiece located below the punch 74. It should be noted that an extended stroke of the gagging member 50 is provided such that the lower surface 53 of the extension 54 is substantially over the circumferential extent of the punch receiving hole 72 to provide a full support surface behind the punch 74 to counteract the substantial forces encountered during a punching process. The slot 62 formed adjacent the nose 12 of the change retainer body 10 receives the ramp end of the gagging member extension 54 to accommodate the additional stroke required for full support of the punch retainer 64 behind the punch receiving hole 72, as provided by engagement of the lower surface 53 of the extension 54 with the upper surface 71 of the backing plate 70.

Figure 8:
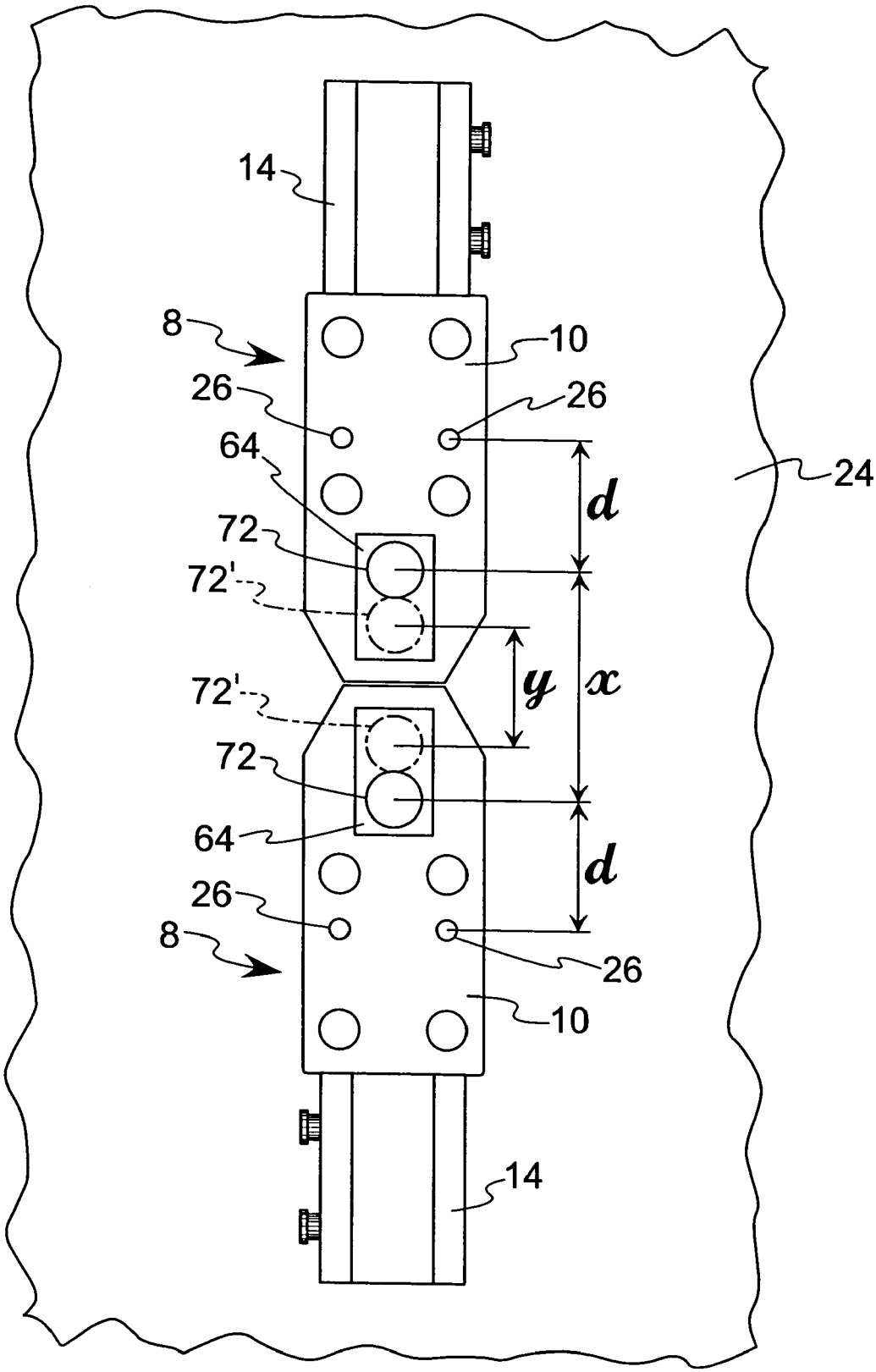
FIG. 8 is bottom plan view of two change retainers of the present invention located in nose-to-nose relation and illustrating a position for the punches held by the floating punch retainers to position the punches closely adjacent to each other.

FIG. 8 illustrates an application of the present invention in which two of the change retainers 8 of the present invention are mounted on a die shoe 24 in nose-to-nose relationship to each other. In an initial configuration of the punch retainers 64, as depicted by the solid lined punch receiving holes 72, the punch spacing may be selected to provide a wide, or conventional, spacing, x, for the holes to be formed by the punches. In the alternative configuration of the punch retainers, as depicted by the dotted lined punch receiving holes 72', the punch spacing may be adjusted to provide a closer spacing, y, between the holes to be formed by the punches operated by the change retainers 8. It can be seen that by providing alternative spacing for punches, utilizing the same change retainer structure for alternative configurations, additional tooling options are provided while avoiding costs normally associated with restructuring punch tooling in a punch and die assembly. It should be understood that additional spacing variations may be provided by changing, i.e., increasing, the spacing between the adjacent change retainers 8, where the alternative positioning of the punch retainers 64 within their respective change retainers 8 provides a plurality of alternative configurations at any given spacing of the change retainers 8.

Further, it should be understood that the locations of the pawl apertures and the pawl receiving passage may be reversed to mount a pawl element on the floating punch retainer and to provide a cooperating passage on the change retainer body, or alternative cooperating elements may be provided to facilitate positioning of the punch retainer to a desired rotational orientation, including positioning of the punch receiving hole to different locations relative to the change retainer body. Additionally, it should be understood that references to particular directional orientations, including the use of terms such as up, down, front, rear, top and bottom, are used for relative reference purposes to describe the embodiment disclosed herein and are not intended as limiting to a particular mounting or orientation of the apparatus disclosed and claimed herein.

Having described the invention in detail and by reference to a preferred embodiment thereof, it will be apparent that modifications and variations are possible without departing from the scope of the invention defined in the appended claims.

What is claimed is:

1. A punch change retainer positioning a floating punch retainer in a retracted, disengage position and an extended, engage position, the change retainer comprising:

a change retainer body including a nose portion at a front end of the change retainer body and an actuator at a rear end of the change retainer body;

a punch retainer receiving aperture extending upwardly through the change retainer body from a bottom surface thereof;

a gagging member actuable by the actuator between a retracted position distal from the nose portion of the change retainer body and an extended position adjacent the nose portion of the change retainer body;

a floating punch retainer receivable within the punch retainer receiving aperture, an upper end of the floating punch retainer positioned for engagement with the gagging member, the floating punch retainer defining a longitudinal center line located in a front to rear direction;

a punch receiving hole defined in the floating punch retainer; and the floating punch retainer being rotatably positioned about the longitudinal center line within the punch retainer receiving aperture.

2. The change retainer of claim 1 wherein the floating punch retainer is generally symmetrical about the longitudinal center line.

3. The change retainer of claim 1 wherein the punch receiving hole is offset from the longitudinal center line and rotation of the floating punch retainer within the punch retainer receiving aperture varies the distance of the punch receiving hole from the nose portion of the change retainer body.

4. The change retainer of claim 3 wherein the floating punch retainer defines at least two different positions in the front to rear direction for the punch receiving hole, and the gagging member is extendable to locations located substantially over the punch receiving hole in each of the different positions of the punch receiving hole.

5. The change retainer of claim 1 wherein the floating punch retainer includes lateral extensions extending beyond lateral sides at an upper end of the floating punch retainer, the lateral extensions located in facing relationship to ledges defined in the change retainer body.

6. The change retainer of claim 5 including a pawl element located in one of the lateral extensions and the ledges for cooperating with a passage in the other of the lateral extensions and the ledges.

7. The change retainer of claim 6 wherein the pawl element is movable to a location on an opposite one of lateral extensions and the ledges to permit positioning of the punch receiving hole to a different location within the change retainer body.

8. The change retainer of claim 5 including spring biasing means engaging between the lateral extensions and the ledges to bias the floating punch retainer to the retracted position.

9. The change retainer of claim 1 wherein the floating punch retainer includes front and rear ramp portions defined at front and rear sides of an upper end of the floating punch retainer for engaging with the gagging member.

10. The change retainer of claim 9 wherein the floating punch retainer comprises a punch retainer body and a backing plate attached to the punch retainer body and the ramp portions are defined in the backing plate.

* * * * *